United States Patent [19]

Baker

[11] 4,361,158

[45] Nov. 30, 1982

[54] HAIR REPAIR HOOD

[76] Inventor: Gerald W. Baker, 609 N. 5th, Okemah, Okla. 74859

[21] Appl. No.: 84,906

[22] Filed: Oct. 15, 1979

[51] Int. Cl.[3] ..... A45D 1/00

[52] U.S. Cl. ..... 132/9

[58] Field of Search ..... 132/9; 128/64, 65, 61; 15/227

[56] References Cited

U.S. PATENT DOCUMENTS

| | | | |
|---|---|---|---|
| 718,958 | 1/1903 | Turck | 128/61 |
| 2,030,494 | 2/1936 | Bireley et al. | 15/227 |
| 2,289,209 | 7/1942 | Reiches | 132/9 |
| 2,856,918 | 10/1958 | Kingery et al. | 132/9 X |
| 3,044,473 | 7/1962 | Caver | 132/9 |
| 3,177,868 | 4/1965 | Wallace et al. | 132/9 X |
| 3,456,655 | 7/1969 | Hale | 132/9 |

*Primary Examiner*—G. E. McNeill

*Attorney, Agent, or Firm*—Head, Johnson & Stevenson

[57] ABSTRACT

A device for shampooing a person's hair; including a double walled hood having a pair of openings fitted with gloves extending inwardly; a swivel spray head through the hood, and a drain hose at the hood's lower end fitted with a hair trap.

9 Claims, 4 Drawing Figures

14
15
16
11
20
10
13
12
18
61
17
21
24
19
22
23
33
25
32
27
28

11
3
3
60

11
20
21
21
20
12

33
35
31
35
34
17
32
30
45
56
46
55
54
26
42
37
52
36
40
38
48
39
28
49
47
50
59
57
53
58
41
43
51
44

HAIR REPAIR HOOD

SUMMARY OF THE INVENTION

This invention relates generally to an hair and scalp shampooing apparatus.

A principal object of the present invention is to provide an improved shampooing apparatus, one which maybe used on persons who are bedfast or in wheelchairs, in a hospital, nursing home, in addition to those who are well and able to pay a visit to a beauty shop.

Another object is to provide a shampooing apparatus which allows a person to be either seated or lying down while being treated.

PREFERRED EMBODIMENT

Figure 1:
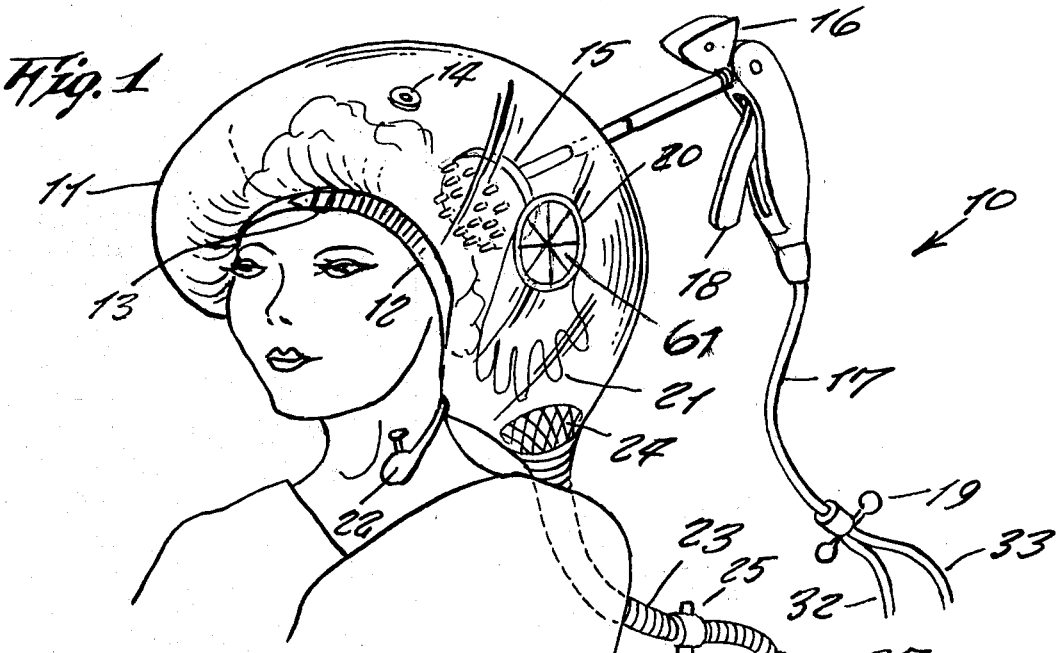
FIG. 1 is a perspective view of the invention's hood installed on a person's head.

Referring now to the invention in greater detail. The reference numeral 10 represents an apparatus according to the present invention wherein there is a double walled transparent plastic hood 11 for fitting on a person's head, for enclosing the scalp and hair. A band 12 of the hood extends around the forehead and under the ears. The band includes either a buckle 13 or draw strings. Sprayer holes 14 on right and left side of the hood allows a jointed water sprayer 15 to extend into the hood and spray the hair. A shampoo dispenser 16 is mounted on the outer end of the sprayer for mixing with water delivered from hose 17 to the sprayer. A control handle 18 controls the water spray. A temperature control valve 19 regulates the water temperature.

A large opening 20 on the right and left sides of the hood are each fitted with a rubber glove 21, extending inside the hood to allow an attendant to place his or her hands therein and lather or massage the hair or scalp without water splashing out.

An air pump 22 serves to inflate the hood like a balloon, and a relief valve serves to extract the air. A water drain hose 23 connected to a lower end of the hood is fitted with a hair trap 24. A clamp 25 fits o the hose when the appliance 26 as shown on FIG. 4 is not used.

Figure 4:
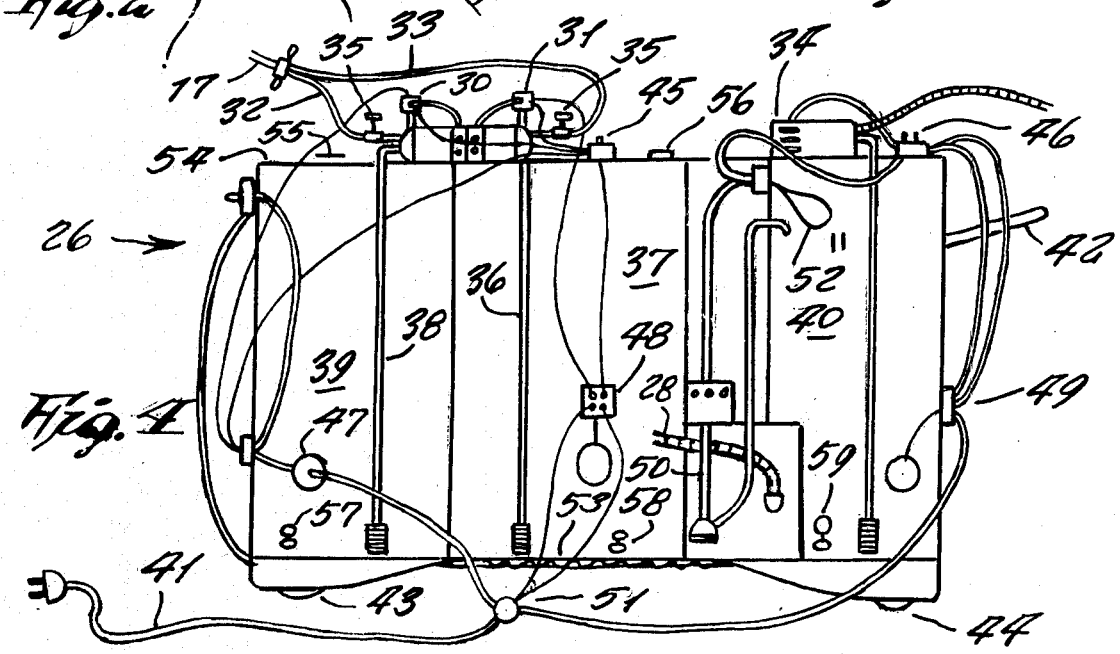
FIG. 4 is a view of an appliance for use therewith where there is no immediate water supply.

As shown in FIG. 4 the appliance includes a water pump and pressure switches 30 and 31, cold water hose 32 and hot water hose 33 leading thereto. Disposal tank pump and hose 34, cold and hot water valves 35, supply line and foot valve 36 to the hot water tank 37. Supply line and foot valve 38 to the cold water tank 39, disposal tank 40, unit power cord 41, cart handle 42, cart front wheels 43, swivel back wheels 44, power switch 45, disposal tank pump switches 46, tank float and cut off switches 47, 48 and 49, pump and hose 50, unit wiring 51, tank float and cut off switch 52, water warmer and switch 53, cart frame 54, tank filler openings 55 and 56, and drains 57, 58 and 59.

Figure 2:
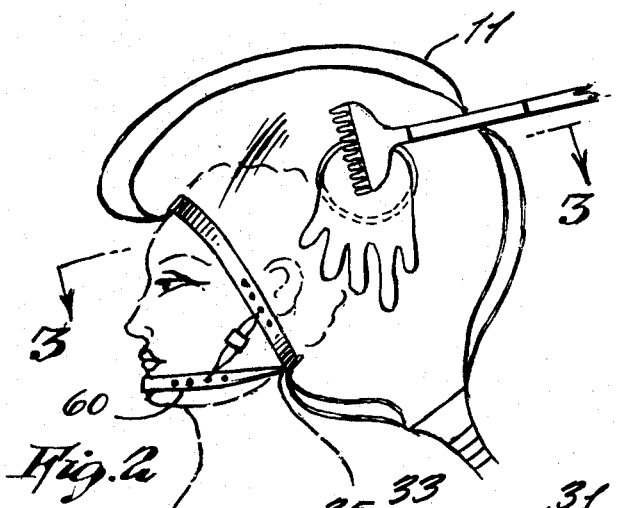
FIG. 2 is a side cross sectional view thereof, showing the apparatus in use.
Figure 3:
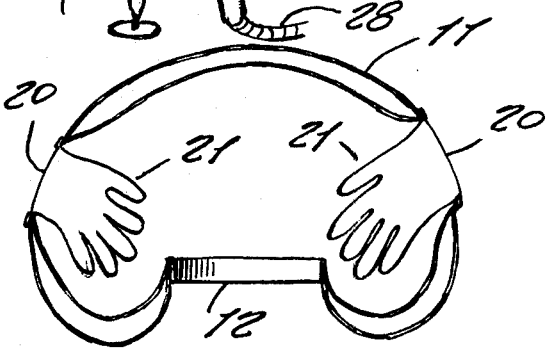
FIG. 3 is a cross sectional view on line 3—3 of FIG. 2.

It is to be noted in FIG. 2, that an adjustable chin strap 60 may be additionally employed.

It is also understood that changes in construction maybe made, as long as they are limited to the scope of the appended claims.

It is also to be noted in FIG. 1, that a split panel 61 may be additionally employed instead of swivel glove 21.

I claim:

1. A shampooing apparatus comprising an open ended hood means having spray hole means provided therein for receiving spray means therethrough, water conduit means operably connected with the spray means for suppling water thereto during a shampooing operation, soap dispensing means operably connected with the hood means for supplying soap to the interior thereof during said shampooing operation, valve means interposed in said water conduit means for selectively testing the water temperature prior to directing the water to the spray means, said hood means being provided with opening means therein for access to the interior thereof whereby the hands of an operator may be inserted through said opening means for facilitating the shampooing operation, drain hose means operably connected to the hood means and having one end open to the interior of the hood means and the opposite end open for discharge of water from said hood means during the shampooing operation.

2. A shampooing apparatus as set forth in claim 1 and including hair trap means disposed at the said one open end of the drain hose means for precluding entry of loose hair into the drain hose means.

3. A shampooing apparatus as set forth in claim 1 wherein the opening means comprises at least one sealed opening provided in said hood means for substantially precluding leakage of water therefrom at all times during a shampooing operation.

4. A shampooing apparatus as set forth in claim 2 wherein the opening means includes at least two openings each having a split panel disposed therein for sealing of the opening means in the normal position thereof and sealing around the hand of the operator inserted therethrough.

5. A shampooing apparatus as set forth in claim 1 wherein the opening means comprises at least one opening provided in said hood means, and glove means secured to the periphery of said opening and having one end open to the exterior of the hood means for receiving the hand therethrough and the opposite end extending into the interior of the hood whereby the hand may be utilized for facilitating said shampooing operation.

6. A shampooing apparatus as set forth in claim 1 wherein the hood means comprises a body of a substantially cap-shaped configuration having an opening therein for disposition about the head of a person during the shampooing operation, said body being of a double walled construction for providing an air space for inflation of the hood means.

7. A shampooing apparatus as set forth in claim 1 and including auxiliary water supply means operably connected with said water supply conduit means for supplying said water thereto.

8. A shampooing apparatus as set forth in claim 6 wherein said auxiliary water supply means comprises water tank means for housing a supply of water, pump means operably secured between the water tank means and the water conduit means for delivery of the water from the tank to the water conduit means, water disposal tank means operably connected with said drain hose means for receiving the discharging water therefrom.

9. A shampooing apparatus as set forth in claim 6 wherein said auxiliary water supply means is provided with wheel means for portability thereof.

* * * * *